US008249478B2

(12) United States Patent
Bae

(10) Patent No.: US 8,249,478 B2
(45) Date of Patent: Aug. 21, 2012

(54) FUSING UNIT TO FUSE DEVELOPING AGENT ON A PRINT MEDIUM, IMAGE FORMING APPARATUS, AND METHOD OF CONTROLLING THE SAME

(75) Inventor: Sea Chul Bae, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 424 days.

(21) Appl. No.: 12/578,444

(22) Filed: Oct. 13, 2009

(65) Prior Publication Data

US 2010/0098469 A1 Apr. 22, 2010

(30) Foreign Application Priority Data

Oct. 21, 2008 (KR) ..... 10-2008-0102955

(51) Int. Cl.
*G03G 15/20* (2006.01)

(52) U.S. Cl. ..... 399/67; 399/329

(58) Field of Classification Search ..... 399/67, 399/320, 328, 329
See application file for complete search history.

(56) References Cited

U.S. PATENT DOCUMENTS 6,804,478 B2 * 10/2004 Martin et al. ..... 399/67
7,805,090 B2 * 9/2010 Ferencz, Jr. ..... 399/67

FOREIGN PATENT DOCUMENTS

JP 06-130829 5/1994
JP 11-161068 6/1999

OTHER PUBLICATIONS

English language abstract of JP 06-130829, published May 13, 1994.
Machine English language translation of JP 06-130829, published May 13, 1994.
English language abstract of JP 11-161068, published Jun. 18, 1999.
Machine English language translation of JP 11-161068, published Jun. 18, 1999.

* cited by examiner

*Primary Examiner* — William J Royer
(74) *Attorney, Agent, or Firm* — Stanzione & Kim, LLP

(57) ABSTRACT

Disclosed are a fusing unit, an image forming apparatus employing the fusing unit and a method of controlling the same. The fusing unit disclosed herein includes a heating belt having a non-conductive outer surface and a pressing roller that allows a print medium to be in pressing contact with the outer surface of the heating belt. A negative voltage or a positive voltage is selectively applied to the pressing roller based on the presence of a print medium between the pressing roller and the heating belt.

20 Claims, 6 Drawing Sheets

FUSING UNIT TO FUSE DEVELOPING AGENT ON A PRINT MEDIUM, IMAGE FORMING APPARATUS, AND METHOD OF CONTROLLING THE SAME

CROSS-REFERENCE TO RELATED APPLICATIONS

This application claims the benefit of Korean Patent Application No. 10-2008-0102955, filed on Oct. 21, 2008, in the Korean Intellectual Property Office, the entire disclosure of which is incorporated herein by reference.

BACKGROUND OF THE INVENTION

1. Field of the Invention

The present disclosure relates generally to an image forming apparatus, and, more particularly, to an image forming apparatus equipped with a fusing unit to fuse developing agent onto a print medium and a method of controlling the same.

2. Description of the Related Art

In general, an image forming apparatus forms an image on a print medium according to input image signals, and may include, for example, a printer, a copy machine, a facsimile and a multi-functional peripheral (MFP) having a combination of several functions of the above devices.

An image forming apparatus typically include a body or casing accommodating therein several components, such as, for example, a print medium supplying unit, a developing unit, an exposing unit, a fusing unit and a print medium discharging unit. The body may form the external appearance of the image forming apparatus. The print medium supplying unit stores a plurality of print media on which the images are to be formed. The developing unit applies developing agent to an electrostatic latent image to develop the same into a visible image. The electrostatic latent image may be formed by irradiating light onto a photosensitive member that had been pre-charged. The photosensitive member may be provided as a part of the developing unit, for example, which applies developing agent, e.g., toner, on the electrostatic latent image to develop the electrostatic latent image into the visible image. Subsequently, the visible image developed on the photosensitive member is transferred to a print medium supplied from the print medium supplying unit. After the visible developer image is transferred to a print medium, the fusing unit is utilized to fuse or fix the developing agent on the print medium. The print medium discharging unit discharges the print medium bearing the fixed developer image out of the body of the image forming apparatus.

A known fusing unit may be of a configuration that includes a pressing roller, a heating belt, a pair of support rollers and a heater. In such configuration, the heating belt may be arranged to move in close contact with an outer surface of the pressing roller. The support rollers may be arranged to support the inner portions of the heating belt. The heater may provide the heat to the heating belt. In the above described configuration, when the print medium, on which the developing agent has been transferred, passes through between the pressing roller and the heating belt, heat and pressure are applied to the print medium so that the developing agent is fused onto the print medium.

During the fusing process, however, an amount of charge in the developing agent may become reduced, resulting in a lowered adhesion of the developing agent to the print medium. For example, as moisture evaporates from the print medium due to the heat applied from the heating belt, some of the developing agent may even become detached from the print medium, resulting in a so-called "line burst phenomenon."

Known attempts to reduce the occurrences of the line burst phenomenon include supplying the pressing roller with an electrical potential of a polarity opposite to that of the developing agent so as to cause the print medium to have a polarity opposite to that of the developing agent, resulting in an electrical attractive force acting between the developing agent and the print medium. For example, when the developing agent is charged with a negative polarity, a positive voltage is applied to the pressing roller so that the print medium is charged with a positive polarity. The electrical attractive force between the oppositely charged print medium and developing agent may help to reduce the line burst phenomenon.

However, unfortunately, while helpful in some respect as above described, when the heating belt is brought into contact with the pressing roller exhibiting a polarity, for example, a positive polarity, the surface of the heating belt may also gradually become charged with the positive polarity by the pressing roller. Such heating belt charged with a polarity may attract the developing agent charged with an opposite polarity, such attraction of which may result in a lower fusing efficiency.

SUMMARY OF THE INVENTION

According to an aspect of the present disclosure, a fusing unit may be provided for fusing developing agent on a print medium, and to include a heating belt and a pressing roller. The heating belt may have an outer surface that is electrically non-conductive. The pressing roller may be arranged to face the outer surface of the heating belt in such manner to cause the print medium, when it is positioned between the pressing roller and the heating belt, to be in pressing contact with the heating belt. The pressing roller may be configured to receive a select one of a positive voltage and a negative voltage based on whether the print medium is present between the pressing roller and the healing belt.

The inner surface of the heating belt may be electrically conductive, and may be grounded.

The fusing unit may further comprise a first support roller and a second support roller. The first support roller may be arranged to opposingly face the pressing roller with the heating belt interposed between the first support roller and the pressing roller. The second support roller may be spaced apart from the first support roller. The inner surface of the heating belt may be supported by the first and second support rollers.

The fusing unit may further comprise a heater that may be configured to generate heat and to supply the generated heat to the heating belt.

According to another aspect, an image forming apparatus may be provided to include a heating belt, a pressing roller and a power supply device. The heating belt may have an outer surface that is electrically non-conductive. The pressing roller may be arranged to face the outer surface of the heating belt in such manner to cause a print medium positioned between the pressing roller and the heating belt to be in pressing contact with the heating belt. The power supply device may be configured to apply a select one of a positive voltage and a negative voltage to the pressing roller based on whether the print medium is present between the pressing roller and the heating belt.

The image forming apparatus may further comprise a print medium detector which may be disposed along a travel path of the print medium within the image forming apparatus, and which may be configured to generate a detection signal upon detecting a presence of the print medium. The controller may be configured to receive the detection signal from the print medium detector, and to control the power supply device to supply the select one of the positive voltage and the negative voltage based on the received detection signal.

The power supply device may comprise a switching device configured to switchably connect one of the positive voltage and the negative voltage from the power supply device to the pressing roller.

According to yet another aspect, a method of controlling an image forming apparatus that includes a fusing unit having a heating belt and a pressing roller for fusing developing agent to a print medium may include determining if the print medium is present between the pressing roller and the heating belt; and adjusting a polarity of a voltage applied to the pressing roller according to whether the print medium is determined to be present between the pressing roller and the heating belt The method may further comprise determining a polarity of the developing agent prior to adjusting the polarity of the voltage applied to the pressing roller.

The step of adjusting the polarity of the voltage applied to the pressing roller may comprise applying a first voltage of a first polarity that is opposite to a second polarity of the developing agent to the pressing roller when the print medium is determined to be present between the pressing roller and the heating belt.

The step of adjusting the polarity of the voltage applied to the pressing roller may further comprise applying a second voltage of the second polarity to the pressing roller when it is determined that no print medium is present between the pressing roller and the heating belt.

The step of applying the first voltage of the first polarity may comprise determining if the developing agent has a positive polarity; and applying a negative voltage to the pressing roller if the polarity of the developing agent is determined to be positive.

The step of applying the first voltage of the first polarity may comprise determining if the developing agent has a positive polarity; and applying a positive voltage to the pressing roller if it is determined that the polarity of the developing agent is not positive.

According to even yet another aspect, a method of controlling an image forming apparatus that includes a fusing unit having a heating belt and a pressing roller for fusing developing agent having a charge of a first polarity to a print medium may be provided to include: determining whether the print medium is present between the pressing roller and the heating belt; applying a voltage having a second polarity opposite to the first polarity of the developing agent to the pressing roller when it is determined that the print medium is present between the pressing roller and the heating belt; and applying a voltage having the first polarity to the pressing roller when it is determined that the print medium is not present between the pressing roller and the heating belt.

The step of applying the voltage having the second polarity may comprise determining if the first polarity of the developing agent is positive; applying a negative voltage to the pressing roller if the first polarity of the developing agent is determined to be positive; and applying a positive voltage to the pressing roller if it is determined that the first polarity of the developing agent is not positive.

According to still yet another aspect, an image forming apparatus for forming an image using developing agent having an electrical charge of a first polarity may be provided to include a heating belt, a heat source, a pressing roller, a power supply device and a controller. The heating belt may be configured to rotate to define a rotational loop. The heat source may be configured to supply heat to the heating belt. The pressing roller may be arranged outside the rotational loop of the heating belt and to opposingly face the heating belt so as to form a contact nip with the heating belt. The power supply device may be configured to output a first voltage of the first polarity and a second voltage of a second polarity opposite to the first polarity. The controller may be configured to control the power supply device to selectively output to the pressing roller the second voltage of the second polarity when there is a print medium positioned between the pressing roller and the heating belt and the first voltage of the first polarity when there is no print medium positioned between the pressing roller and the heating belt.

The image forming apparatus may further comprise a detector, which is disposed along a travel path of the print medium within the image forming apparatus, and which is configured to generate a detection signal upon detecting a presence of the print medium. The controller may be configured to receive the detection signal item the detector, and to control the power supply device to supply a select one of the first voltage and the second voltage based on the received detection signal.

The inner surface of the heating belt may be electrically conductive. The outer surface of the heating belt may be electrically non-conductive.

The heat source may be disposed inside the rotational loop of the heating belt.

The first polarity may be positive.

BRIEF DESCRIPTION OF THE DRAWINGS

Various features and advantages of the present disclosure will become apparent and more readily appreciated from the following description of several embodiments thereof, taken in conjunction with the accompanying drawings of which.

DETAILED DESCRIPTION OF THE PREFERRED EMBODIMENTS

Figure 1:
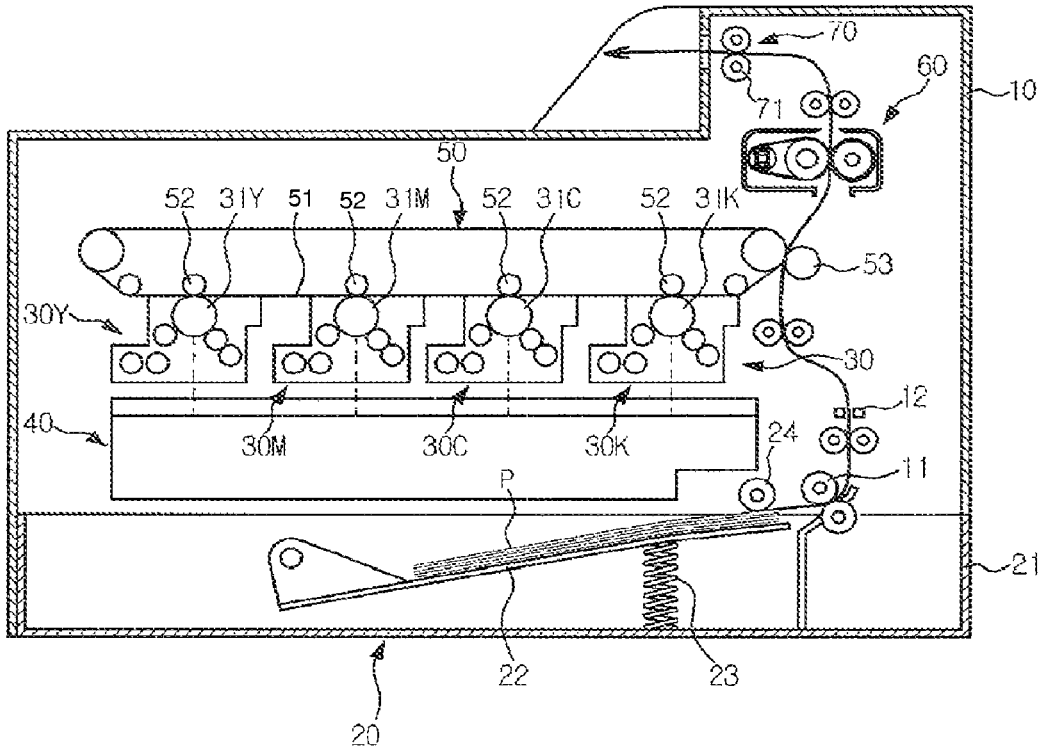
FIG. 1 is a sectional view schematically illustrating the relevant configuration of an image forming apparatus according to an embodiment.

Reference will now be made in detail to several embodiments, examples of which are illustrated in the accompanying drawings, wherein like reference numerals refer to the like elements throughout.

As shown in FIG. 1, an image forming apparatus according to an embodiment may include a body 10, a print medium supplying unit 20, a plurality of developing units 30 (30K, 30C, 30M and 30Y), an exposing unit 40, a transfer unit 50, a fusing unit 60 and a print medium discharging unit 70. The body 10 may define the external appearance of the image forming apparatus. The print medium supplying unit 20 may store therein one or more print media P (print medium) that are to be used in the image forming apparatus. The developing units 30K, 30C, 30M and 30Y may develop an electrostatic latent image into a visible image by using developing agent of respective colors, such as, for example, black, cyan, magenta and yellow. The exposing unit 40 may be configured to form the electrostatic latent image on photosensitive members 31K, 31C, 31M and 31Y of the developing units 30K, 30C, 30M and 30Y, respectively. The transfer unit 50 may be configured to transfer the visible image formed on the photosensitive members 31K, 31C, 31M and 31Y onto the print medium P. The fusing unit 60 may be configured to fuse the developing agent onto the print medium P. The print medium discharging unit 70 discharges the print medium P, onto which the visible image is fused, to the outside of the body 10.

The print medium supplying unit 20 may include a print medium cassette 21, a knock-up plate 22 and a pick-up roller 24. The print medium cassette 21 may be detachably coupled to the body 10, for example, in the form of a drawer. The knock-up plate 22 may be arranged in the print medium cassette 21 to receive thereon the print media P. The pick-up roller 24 may be provided in the body 10 to pick up the print media P placed on the knock-up plate 22 one by one, and to deliver the picked up print medium P to the transfer unit 50. The knock-up plate 22 may have a first end that is pivotably supported and a second end elastically supported by an elastic member 23. One or more feed roller(s) 11 may be provided in the body 10 to deliver the print mediums P picked-up by the pick-up roller 24 to the transfer unit 50.

The exposing unit 40 irradiates light having image information on the photosensitive members 31K, 31C, 31M and 31Y to thereby form electrostatic latent images on the surfaces thereof.

The developing units 30K, 30C, 30M and 30Y may contain therein developing agents, and may supply the developing agents to the surfaces of the photosensitive members 31K, 31 C, 31M and 31 Y to develop the electrostatic latent images thereof into a visible developer image. While, in the above description of an embodiment, four developing units 30K, 30C, 30M and 30Y containing developing agents of black (K), cyan (C), magenta (M) and yellow (Y), respectively are employed to form color images, it should be understood that the number of the developing units is not so limited, and may be any number, including only one such developing unit, for example, in the case of monochromatic image forming apparatus.

The transfer unit 50 may include an intermediate transfer belt 51, first transfer rollers 52 and a second transfer roller 53. The intermediate transfer belt 51 may be configured to receive the visible developer images from the photosensitive members 31K, 31 C, 31 M and 31 Y. To that end, the first transfer rollers 52 may be arranged to opposingly face the respective photosensitive members 31K, 31C, 31M and 31 Y while the intermediate transfer belt 51 being interposed therebetween so that the visible developer images of the photosensitive members 31K, 31C, 31M and 31Y may be transferred to the intermediate transfer belt 51. The second transfer roller 53 in turn allows the visible developer images to be transferred from the intermediate transfer belt 51 onto a print medium P supplied from the print medium P supplying unit 20 as the print medium is muted to pass between the second transfer roller 53 and the intermediate transfer belt 51. According to another embodiment, the print medium P may alternatively be muted to contact the photosensitive members 31K, 31C, 31 M and 31 Y, to thereby have the visible developer images transferred thereto directly from the photosensitive members 31K, 31 C, 31M and 31 Y.

The print medium discharging unit 70 may include one or more of print medium discharging rollers 71 arranged to discharge the print medium P that has passed through the fusing unit 60 to the outside of the body 10.

Figure 2:
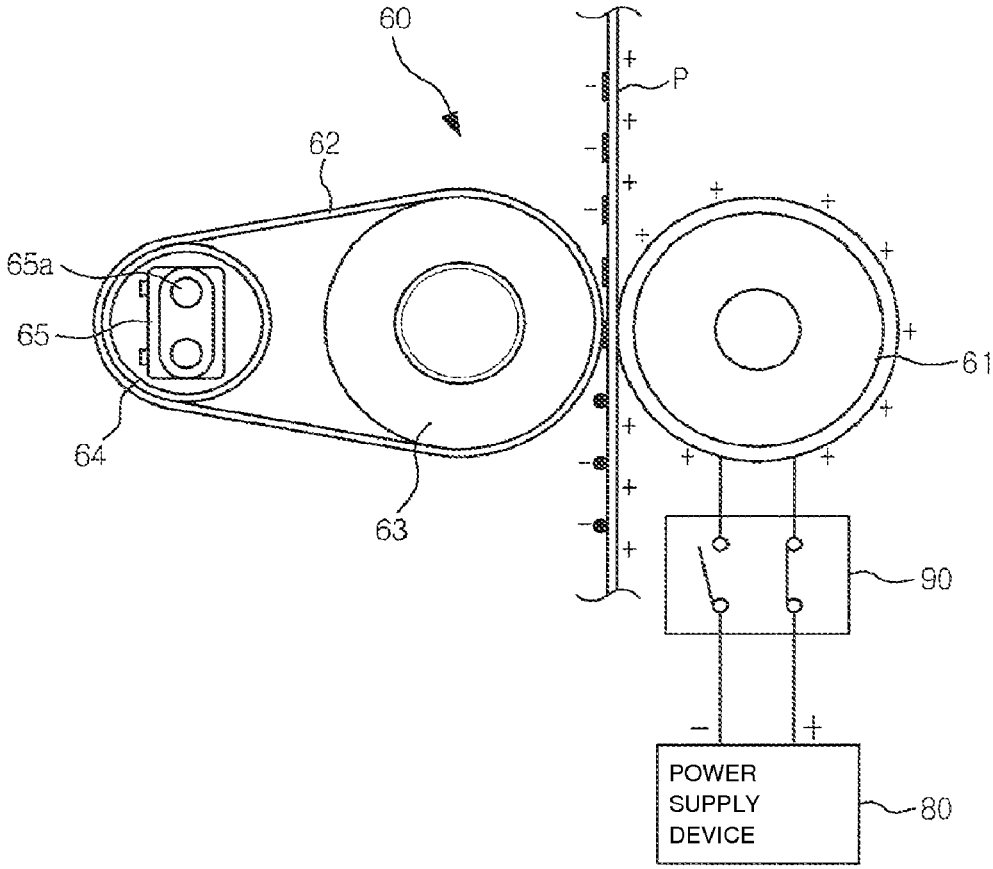
FIGS. 2 and 3 are schematic views illustrative of operations of a fusing unit according to an embodiment.
Figure 3:
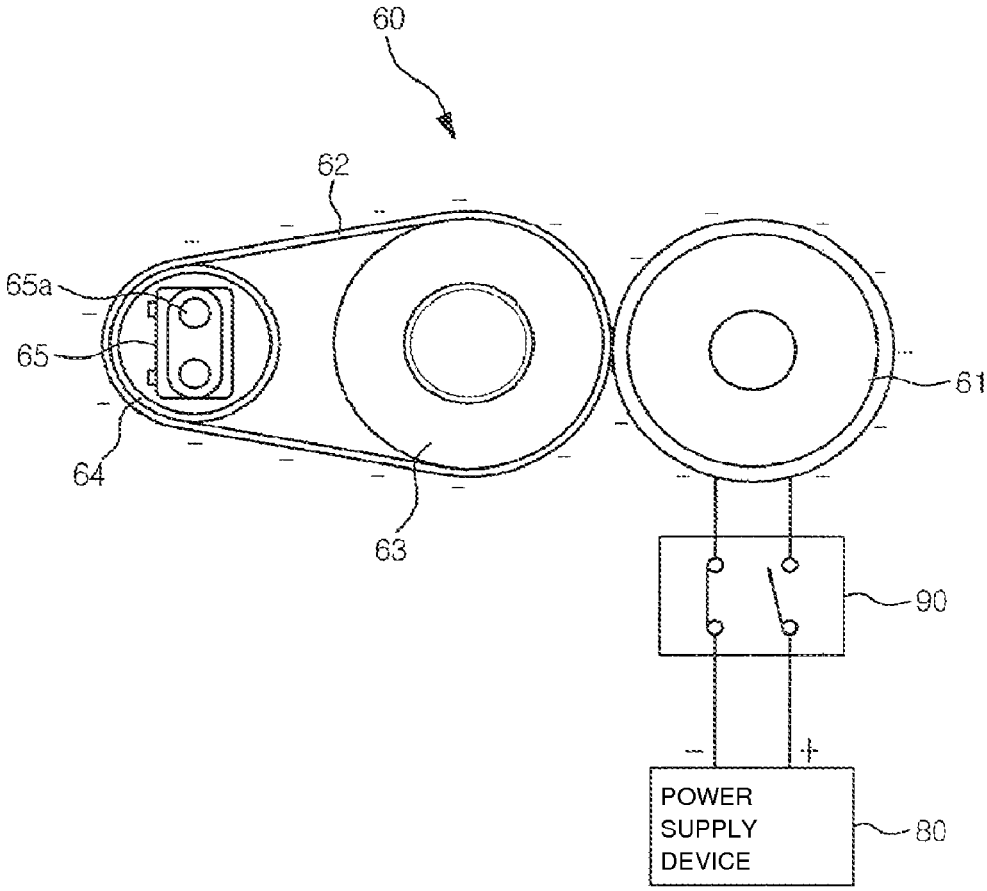

As shown in FIGS. 2 and 3, the fusing unit 60 according to an embodiment may include a pressing roller 61 having an outer surface that includes an elastic material and a heating belt 62 arranged to move in close contact with the outer surface of the pressing roller 61 so that a print medium P passing therebetween is pressed by the pressing roller 61 against the heating belt 62. The print medium P carrying thereon an image in the form of developing agents may thus be heated and pressed while passing through between the pressing roller 61 and the heating belt 62 so as to fuse the developing agents to the print medium P. First and second support rollers 63 and 64 may be provided to support the inner portions of the heating belt 62. The first support roller 63 may be arranged to face the pressing roller 61 with the heating belt 62 interposed there between, and to support one side of the heating belt 62. The second support roller 64 may be arranged to support the other side of the heating belt 62. According to an embodiment, the second support roller 64 may be provided therein with a heater 65 to heat the second support roller 64. The heater 65 may include, for example, a heating lamp 65*a* generating the heat, which is delivered to the heating belt 62 through the second support roller 64.

In a fusing unit 60 according to an embodiment, a positive voltage or a negative voltage may be selectively applied to the pressing roller 61 on the basis of whether the print medium P is present between the pressing roller 61 and the heating belt 62. To that end, according to an embodiment, a print medium detector 12 (see FIG. 1) may be arranged on the movement path of the print medium P to detect the print medium P.

Figure 4:
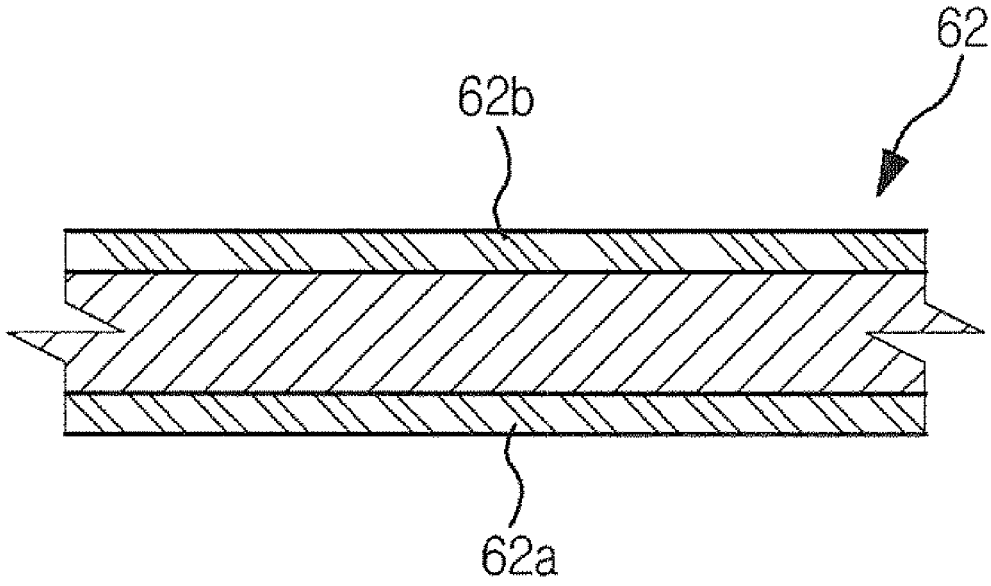
FIG. 4 is a sectional view of a heating belt according to an embodiment.

As illustrated in FIG. 2, if a print medium P is interposed between the pressing roller 61 and the heating belt 62, a voltage having a polarity opposite to that of the developing agent is applied to the pressing roller 61. If on the other hand, as illustrated in FIG. 3, no print medium P is present between the pressing roller 61 and the heating belt 62, a voltage having the same polarity as that of the developing agent is applied to the pressing roller 61. As shown in FIG. 4, a heating belt 62 according to an embodiment may include a conductive layer 62*a* in the inner surface thereof. The conductive layer 62*a* may be grounded so as to discharge electrostatic charges that may be generated during operation. The heating belt 62 according to an embodiment may have a non-conductive layer 62*b* in the outer surface thereof so as to prevent the voltage applied to the pressing roller 61 from being shorted to the ground through the heating belt 62.

When a print medium P is interposed between the pressing roller 61 and the heating belt 62 so that the developing agents may be fused onto the print medium P, the print medium P may be charged with a polarity opposite to that of the developing agents by the pressing roller 61, thereby stably maintaining the developing agents on the print medium P. If the heating belt 62 is allowed to contact the pressing roller 61 so as to be charged with the same polarity as the pressing roller 61 (i.e., charged with opposite polarity of the developing agent), an electrical attractive force may act between the heating belt 62 and the developing agents as previously described, which may lower the fusing efficiency. According to an aspect of the present disclosure, when there is no print medium P present between the pressing roller 61 and the heating belt 62, a voltage having the same polarity as that of the developing agents is applied to the pressing roller 61 so that the heating belt 62 in contact with the pressing roller 61 may also be charged with the same polarity as that of the developing agents, thereby reducing the likelihood of adverse impact on the fusing efficiency.

According to an embodiment, for example, as shown in FIG. 2, the developing agents may be charged with a negative polarity. If the print medium P is interposed between the pressing roller 61 and the heating belt 62, a positive voltage is applied to the pressing roller 61 such that the print medium P is positively charged. If the print medium P is not interposed between the pressing roller 61 and the heating belt 62, a negative voltage is applied to the pressing roller 61 as shown in FIG. 3 so that the heating belt 62 can be negatively charged.

Figure 5:
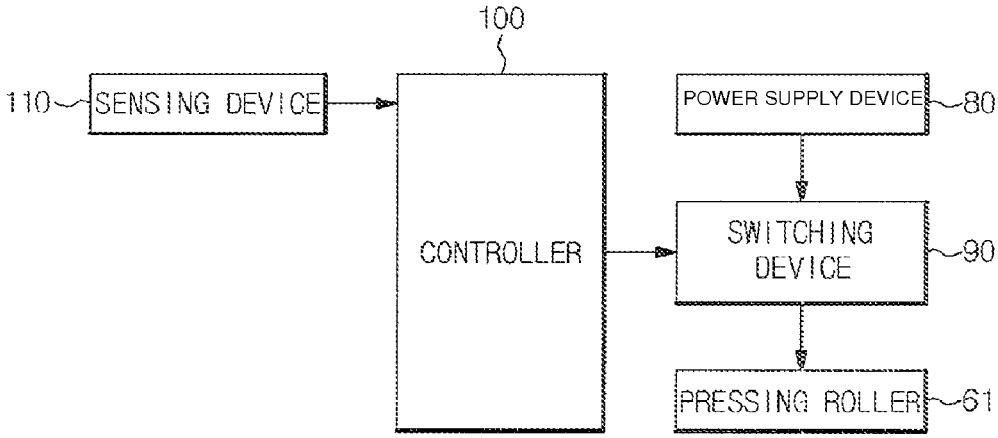
FIG. 5 is a control block diagram of an image forming apparatus according to an embodiment.

As shown in FIG. 5, an image forming apparatus according to an embodiment may include a controller 100, a sensing device 110, a power supply device 80 and a switching device 90. While a detailed structure of the controller 100 is not depicted in FIG. 5, as would be readily understood by those skilled in the art, the controller 100 may be, e.g., a microprocessor, a microcontroller or the like, that includes a CPU to execute one or more computer instructions to implement the various control operations herein described and/or control operations relating to the fusing unit 60 or to other components of the image forming apparatus, such as, for example, one or more of the print medium supply unit 20, the exposing unit 40, the developing units 30K, 30C, 30M and 30Y, the transfer unit 50 and the print medium discharging unit 70, and to that end may further include a memory device, e.g., a Random Access Memory (RAM), Read-Only-Memory (ROM), a flash memory, or the like, to store the one or more computer instructions. The sensing device 110 may include the afore-mentioned print medium detector 12 to determine if the print medium P is interposed between the pressing roller 61 and the heating belt 62. The power supply device 80 may be configured to apply a positive or negative voltage to the pressing roller 61. The switching device 90 may be configured to allow the pressing roller 61 to selectively receive one of a positive voltage and a negative voltage from the power supply device 80 according to the polarity of the developing agents and the existence of the print medium P between the pressing roller 61 and the heating belt 62, which may be detected using the sensing device 110.

The print medium detector 12 of the sensing device 110 that may be provided on the travel path of the print medium P may supply to the controller 100 signals indicative of the presence and/or the absence of a print medium P between the pressing roller 61 and the heating belt 62. According to an embodiment, for example, the controller 100 may be configured to calculate the point in time at which the print medium P passes through between the pressing roller 61 and the heating belt 62 to thereby determine the existence of the print medium P between the pressing roller 61 and the heating belt 62. In such embodiments, the sensing device 110 may be unnecessary. The controller 100 may further be configured to control the operation of the switching device 90 based on the existence of the print medium P such that the switching device 90 selectively delivers one of a negative voltage and a positive voltage from the power supply device 80 to the pressing roller 61.

Hereinafter, a method of controlling the image forming apparatus according to an embodiment will be described.

Figure 6:
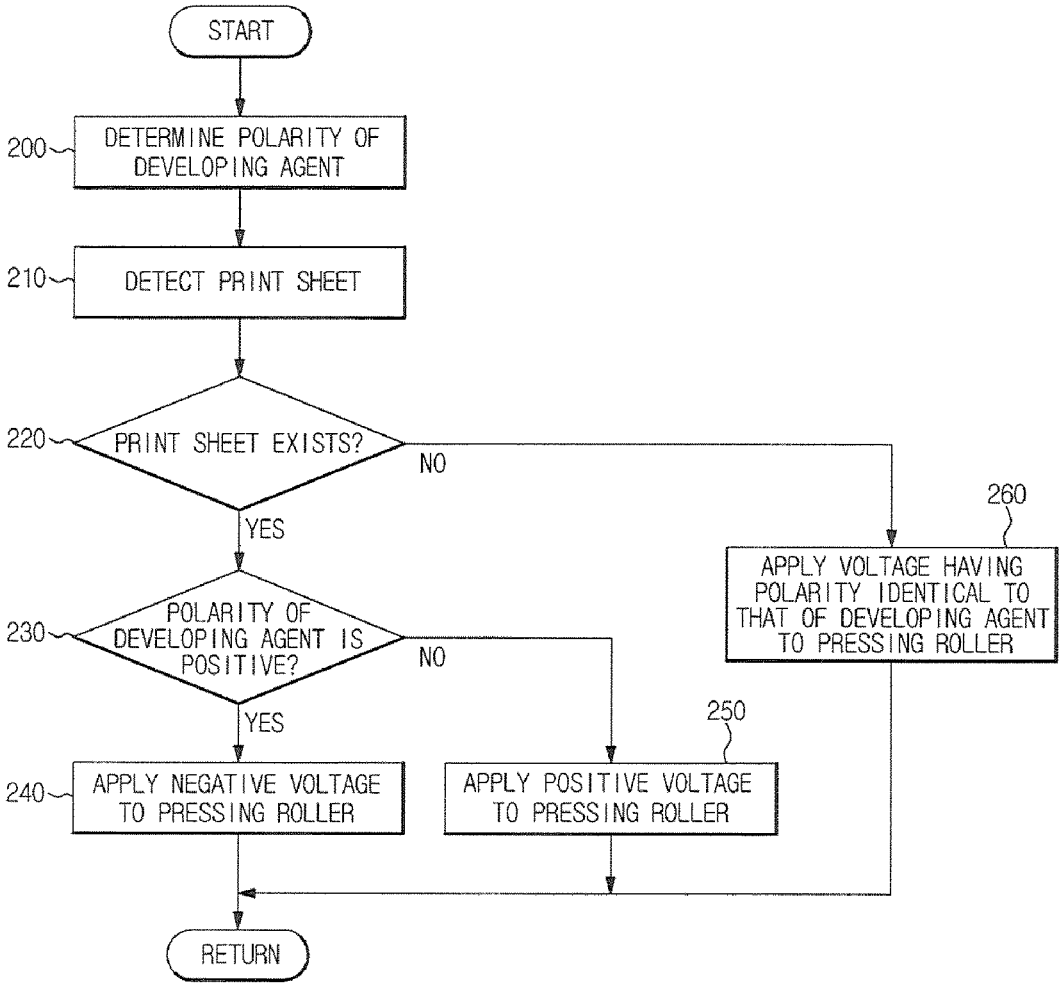
FIG. 6 is a flowchart of a method of controlling the image forming apparatus according to an embodiment.

As shown in FIG. 6, in the method of controlling the image forming apparatus according to an embodiment, the polarity of the developing agents may be determined by the controller 100, for example, by as a preset parameter stored in a memory, as a default setting, or the like (step 200). Then, the sensing device 110 detects through the print medium detector 12 if the print medium P is interposed between the pressing roller 61 and the heating belt 62 (step 210), based on which detection, a determination may be made as to whether a print medium P is present (step 220). According to such determinations relating to the existence of the print medium P between the pressing roller 61 and the heating belt 62, and to the polarity of the developing agents, the polarity of the voltage applied to the pressing roller 61 may be selected. According to an embodiment, the polarity of the developing agents may be set at the time of the manufacture of the image forming apparatus, for example, and thus could be made known to the controller 100.

If it is determined in step 220 that a print medium P is present, then a voltage having a polarity opposite to that of the developing agents is applied to the pressing roller 61. For example, if the polarity of the developing agents was determined to be positive in step 230, then a voltage of negative polarity is applied to the pressing roller 61 (step 240), and if, on the other hand, the polarity of the developing agents was determined to be negative in step 230, then a voltage of positive polarity is applied to the pressing roller 61 (step 250). When it is determined in step 220 that no print medium P is present between the Pressing roller 61 and the heating belt 62, then a voltage having the same polarity as the developing agents is applied to the pressing roller 61 (step 260).

According to one or more of the embodiments herein described, if the developing agents of the first polarity is used, a voltage of the second polarity opposite to the first polarity is applied to the pressing roller 61 when a print medium P is present between the pressing roller 61 and the heating belt 62 so that the print medium P is charged with the second polarity. Accordingly, the developing agents may be stably carried on the print medium P assisted by the attractive force between the oppositely charged developing agents and the print medium P. On the other hand, if no print medium P is present between the pressing roller 61 and the heating belt 62, a voltage of the first polarity is applied to the pressing roller 61 so as to neutralize the charges of the second polarity that may be present in the heating belt 62 or to charge the heating belt 62 with the first polarity through the pressing roller 61.

For example, if negatively charged developing agents are employed, a positive voltage is applied to the pressing roller 61 when there is a print medium P present between the pressing roller 61 and the heating belt 62 while a negative voltage is applied to the pressing roller 61 when no print medium P is present between the pressing roller 61 and the heating belt 62 so the electrons may be delivered to the heating belt 62 through the pressing roller 61. Alternatively, however, if positively charged developing agents are employed, a negative voltage is applied to the pressing roller 61 when there is a print medium P present between the pressing roller 61 and the heating belt 62 while a positive voltage is applied to the pressing roller 61 when no print medium P is present between the pressing roller 61 and the heating belt 62.

According to an aspect of the present disclosure, during the fusing of the developing agent that is, for example, negatively charged to a print medium P passing through the pressing roller 61 and the heating belt 62, even if the heating belt 62 is temporarily charged with a positive polarity, by applying a negative voltage to the pressing roller 61 after the print medium P has passed through between the pressing roller 61 and the heating belt 62, electrons can be delivered to the heating belt 62 through the pressing roller 61 so that the positive polarity of the heating belt 62 can be cancelled, or so that the surface of the heating belt 62 can be negatively charged. It is thus possible to mitigate the lowering of the fusing efficiency due to the attractive interaction between the positively charged heating belt 62 and the negatively charged developing agents.

While the disclosure has been particularly shown and described with reference to several embodiments thereof with particular details, it will be apparent to one of ordinary skill in the art that various changes may be made to these embodiments without departing from the principles and spirit of the invention, the scope of which is defined in the following claims and their equivalents.

The invention claimed is:

1. A fusing unit for fusing developing agent on a print medium, comprising:

a heating belt having an outer surface that is electrically non-conductive;

a pressing roller arranged to face the outer surface of the heating belt in such manner to cause the print medium, when it is positioned between the pressing roller and the heating belt, to be in pressing contact with the heating belt, the pressing roller being configured to receive a select one of a positive voltage and a negative voltage based on whether the print medium is present between the pressing roller and the heating belt.

2. The fusing unit of claim 1, wherein an inner surface the heating belt is electrically conductive, and is grounded.

3. The fusing unit of claim 1, further comprising:

a first support roller opposingly facing the pressing roller with the heating belt interposed between the first support roller and the pressing roller; and a second support roller spaced apart from the first support roller, an inner surface of the heating belt being supported by the first and second support rollers.

4. The fusing unit of claim 3, further comprising a heater configured to generate heat and to supply the generated heat to the heating belt.

5. An image forming apparatus, comprising:

a heating belt having an outer surface that is electrically non-conductive;

a pressing roller arranged to face the outer surface of the heating belt in such manner to cause a print medium positioned between the pressing roller and the heating belt to be in pressing contact with the heating belt; and a power supply device configured to apply a select one of a positive voltage and a negative voltage to the pressing roller based on whether the print medium is present between the pressing roller and the heating belt.

6. The image forming apparatus of claim 5, further comprising:

a print medium detector disposed along a travel path of the print medium within the image forming apparatus, the print medium detector being configured to generate a detection signal upon detecting a presence of the print medium; and a controller configured to receive the detection signal from the print medium detector, and to control the power supply device to supply the select one of the positive voltage and the negative voltage based on the received detection signal.

7. The image forming apparatus of claim 6, wherein the power supply device comprises a switching device configured to switchably connect one of the positive voltage and the negative voltage from the power supply device to the pressing roller.

8. A method of controlling an image forming apparatus that includes a fusing unit having a heating belt and a pressing roller for fusing developing agent to a print medium, comprising: determining if the print medium is present between the pressing roller and the heating belt; and adjusting a polarity of a voltage applied to the pressing roller according to whether the print medium is determined to be present between the pressing roller and the heating belt.

9. The method of claim 8, further comprising:

determining a polarity of the developing agent prior to adjusting the polarity of the voltage applied to the pressing roller.

10. The method of claim 8, wherein the step of adjusting the polarity of the voltage applied to the pressing roller comprises applying a first voltage of a first polarity that is opposite to a second polarity of the developing agent to the pressing roller when the print medium is determined to be present between the pressing roller and the heating belt.

11. The method of claim 10, wherein the step of adjusting the polarity of the voltage applied to the pressing roller further comprises applying a second voltage of the second pointy to the pressing roller when it is determined that no print medium is present between the pressing roller and the heating belt.

12. The method of claim 10, wherein the step of applying the first voltage of the first polarity comprises:

determining if the developing agent has a positive polarity; and applying a negative voltage to the pressing roller if the polarity of the developing agent is determined to be positive.

13. The method of claim 10, wherein the step of applying the first voltage of the first polarity comprises: determining if the developing agent has a positive polarity; and applying a positive voltage to the pressing roller if it is determined that the polarity of the developing agent is not positive.

14. A method of controlling an image forming apparatus that includes a fusing unit having a heating belt and a pressing roller for fusing developing agent having a charge of a first polarity to a print medium, comprising:

determining whether the print medium is present between the pressing roller and the heating belt;

applying a voltage having a second polarity opposite to the first polarity of the developing agent to the pressing roller when it is determined that the print medium is present between the pressing roller and the heating belt; and applying a voltage having the first polarity to the pressing roller when it is determined that the print medium is not present between the pressing roller and the heating belt.

15. The method of claim 14, wherein the step of applying the voltage having the second polarity comprises:

determining if the first polarity of the developing agent is positive; applying a negative voltage to the pressing roller if the first polarity of the developing agent is determined to be positive; and applying a positive voltage to the pressing roller if it is determined that the first polarity of the developing agent is not positive.

16. An image forming apparatus for forming an image using developing agent having an electrical charge of a first polarity, comprising:

a heating belt configured to rotate to define a rotational loop;

a heat source configured to supply heat to the heating belt;

a pressing roller arranged outside the rotational loop of the heating belt and to opposingly face the heating belt so as to form a contact nip with the heating belt;

a power supply device configured to output a first voltage of the first polarity and a second voltage of a second polarity opposite to the first polarity; and a controller configured to control the power supply device to selectively output to the pressing roller the second voltage of the second polarity when there is a print medium positioned between the pressing roller and the heating belt and the first voltage of the first polarity when there is no print medium positioned between the pressing roller and the heating belt.

17. The image forming apparatus of claim 16, further comprising:

a detector disposed along a travel path of the print medium within the image forming apparatus, the detector being configured to generate a detection signal upon detecting a presence of the print medium, wherein the controller is configured to receive the detection signal from the detector, and to control the power supply to supply a select one of the first voltage and the second voltage based on the received detection signal.

18. The image forming apparatus of claim 16, wherein an inner surface of the heating belt is electrically conductive, the outer surface of the heating belt being electrically non-conductive.

19. The image forming apparatus of claim 16, wherein the heat source is disposed inside the rotational loop of the heating belt.

20. The image forming apparatus of claim 16, wherein the first polarity is positive.

* * * * *